US005496130A

United States Patent [19]

Tschegg

[11] Patent Number: 5,496,130

[45] Date of Patent: Mar. 5, 1996

[54] METHOD OF SURFACE TREATING WORKPIECES TO BE COATED

[75] Inventor: Elmar Tschegg, Vienna, Austria

[73] Assignee: Hilti Aktiengesellschaft, Schaan, Liechtenstein

[21] Appl. No.: 274,598

[22] Filed: Jul. 13, 1994

[30] Foreign Application Priority Data

Jul. 13, 1993 [AT] Austria ..... 1377/93

[51] Int. Cl.[6] ..... E01C 7/06

[52] U.S. Cl. ..... 404/75

[58] Field of Search ..... 404/72, 75

[56] References Cited

U.S. PATENT DOCUMENTS 3,846,036 11/1974 Baker ..... 404/75

4,007,995 2/1977 Rotidal ..... 404/77

*Primary Examiner*—William P. Neuder

*Attorney, Agent, or Firm*—Anderson Kill Olick & Oshinsky

[57] ABSTRACT

A method of surface treating workpieces formed of cement, bituminous or other bonding materials to be coated with a cover layer, such as roads, airport and bridge surfaces, and the like, including the steps of roughening the surface to be coated and then cleaning the surface before applying the cover layer, where the roughness depth (RT) corresponds to one-half of the diameter of the largest grain (1) of the surface to be coated or of the cover layer and the width of the undulations of the surface to be coated correspond to the diameter of the largest grain. The undulations can be formed along a single axis or along two axes.

5 Claims, 1 Drawing Sheet

METHOD OF SURFACE TREATING WORKPIECES TO BE COATED

BACKGROUND OF THE INVENTION

The present invention is directed to a method of surface treating workpieces to be coated where the workpieces are formed of a cement, bituminous or other bonded material, such as in roads, airports and bridge surfaces and the like where the surface to be coated is roughened and cleaned before applying the coating or cover layer.

At the present time various methods are used for roughening the surface, for instance, sandblasting, high pressure water jets, needle hammer treatment, countersinking or milling by appropriate diamond or hard metal tipped tool bits, brushing with steel wire brushes, and other similar procedures. In addition to the above mechanical methods, chemical treating methods are also known for roughening and partially removing the surface of structural components and workpieces to be coated. Adhesive agents are also used for increasing the adhesion of the layers to be applied, such as to increase the adhesive bond between old and new concrete. For the most part, a substance constituted of synthetic material or other materials (for instance cement mortar) is applied in the form of a thin layer on a more or less roughened surface of the old concrete. Such substances and methods are offered by many manufacturers and demonstrate how the scientific investigations of Hilsdorf and Belli (influence of adhesive bridges upon the durability of repairs with cement mortar: in Research Road-building and Process Technology, Vol. 342, 8 47–89, 1981), have not resulted in the desired effects, rather they tend to in some cases to be increasingly prone to cracking and weakening of the bond.

The characterization of the adhesive properties of layers or coatings were in the past mostly performed by the pull-off test. A cylinder-shaped test specimen is drilled out perpendicularly to the bonding face extending below the material bond. A steel plate of the same cross-section is bonded to the end face of the test specimen and the drill core is pulled off in the axial direction by a tension testing device. Since the adhesive strength is frequently weaker than the strength of the basic material, a crack formation or fracture occurs more or less in the bonding face. The maximum force required is measured, and divided by the area of the cross-section and the adhesive tensile strength is determined as the sole measured magnitude. This circumstance is viewed as a particular disadvantage of this method, since based on the measured results, it cannot be judged whether the bonding separation occurs in the form of a "brittle" or "ductile" fracture or whether little energy (brittle fracture) or a considerable amount of energy (ductile fracture) has to be expended for breaking the bond. Accordingly, the pull-off test is an inadequate method of characterizing the adhesive bond of material. In spite of this fact, this method has been embodied in several standards.

This situation was improved by the testing device and associated test specimen shapes described in AT 390328. This testing device is suitable for determining fracture mechanism characteristic values of material and material bonds. This method eliminates the above-mentioned disadvantage of the pull-off method. The test method involves basically the wedge splitting arrangement. The test specimen is split at a stable crack-progression by a loaded wedge device on dice or cylinder-shaped test specimens provided with a groove and a stress raiser (position in the material bond). During the measurement the load displacement curve (splitting force as a function of the force displacement or crack in the notch opening) is determined, this affords all the data for complete characterization of the fracture behavior of the material or of the material bond. The surface under the load displacement curve represents the fracture energy required for complete severance of the test specimen. If the fracture energy is divided by the size of the fracture area (only the projection of the ligament area is used), the specific fracture energy $G_f$ is obtained. The $G_f$ value is a characteristic value of the material and represents a measure of resistance to crack propagation. Small $G_f$ values point to a "brittle" material severance and high $G_f$ values indicate "ductile" material severance. It is possible to differentiate between a brittle and ductile material severance on the basis of such a test. Additional information can be gathered directly from the load displacement diagram of the maximum value of the force ($F_{max}$-value). The "notch tensile strength" can be computed from this value. This value is to be viewed in a certain interrelationship with the adhesive strength (determined by the pull-off test).

The characterization of adhesive bonds by this new testing method brings with it new knowledge having decisive significance and considerable influence on the shaping and design of material bonds.

In the publication "Adhesive Power Measurements of Bonds Between Old and New Concrete" in The Journal of Materials Science, 26 (1991), pages 5189–5194 of E. K. Tschegg and S. E. Stanzi, the influence of different old concrete surface treatments as well as bonding agents upon the adhesive old-new concrete bond is investigated by means of the new wedge-splitting method. If these measurement results for the specific fracture energy and for the $F_{max}$ values of the different tested types of bond are standardized to the values of homogeneous concrete then we obtain the following information:

| Pretreatment of the old concrete surface or adhesive agent | $G_f/G_{f0}$ % | $F_{max}/F_{0max}$ % |
|---|---|---|
| Homogeneous concrete | 100 | 100 |
| Shell smooth | 9 | 34 |
| Sand blasted | 20 | 55 |
| Treated with needle hammer | 17 | 50 |
| with emulsion | 7 | 29 |

These values are determined on the following old or new concrete materials:

Old concrete: approximately ½ years old, average quality (B400–500), largest grain size 16 mm New concrete: 28 days old, average quality (B400), largest grain size 16 mm From the above table it is established that the standardized $F_{max}$ value of most investigated specimens actually approaches by about 50% of the value of the homogeneous concrete. This value, however, is not governed or decisive for crack formation bonds, rather it is the specific fracture energy $G_f$. Here the normal standard $G_f$ values are at approximately 10 to 20% (referred to homogeneous concrete). Therefore, if the results of the tear-off tests (similar to the $F_{max}$ values) are used in judging the mechanical properties of the adhesive bond, then with a pretreatment by "sandblasting" a value is obtained of approximately 50%, thus approximately half the old concrete values on the contrary. The material characteristics $G_f$, which is a measure of the crack resistance of the bond and, therefore, has a much higher significance, is more significant for concrete construction and results from this pretreatment in a value of approximately 20%, that is, approximately ⅕ of the old concrete $G_f$ value. As a result, it can be seen from this example that formerly bonds of cement or bituminous bonded material were completely wrongly judged by the tear-off tests and, therefore, the development of measures for improving the adhesion is not attempted or no additional increase in adhesive strength was expected.

In addition, it follows from the above table that only a relatively small increase in adhesion as compared to no treatment at all ("Shellsmooth") has been achieved by the generally used pretreatment of old concrete surfaces by methods such as sandblasting.

SUMMARY OF THE INVENTION

It is the primary object of the present invention to eliminate the disadvantages of the low adhesion (characterized by the $G_f$-value) of material bonds.

In accordance with the present invention, the roughened surface to be coated has a roughness depth corresponding to half of the largest grain diameter of the surface to be coated or of the coating layer and that the undulations have a width corresponding to the diameter of the largest grain.

In a preferred embodiment, the undulations can be formed extending biaxially.

The shape of the undulation is formed as a sine curve or with a triangular or similar shape.

The advantages of the invention can be shown with the help of results from tests as well as observations and considerations of crack propagation in differently shaped bonded surfaces of cement or bituminous bonded material having different aggregate distribution and size.

The various features of novelty which characterize the invention are pointed out with particularity in the claims annexed to and forming a part of this disclosure. For a better understanding of the invention, its operating advantages and specific objects attained by its use, reference should be had to the drawing and descriptive matter in which there is illustrated and described a preferred embodiment of the invention.

DETAILED DESCRIPTION OF THE INVENTION

Figure 1:
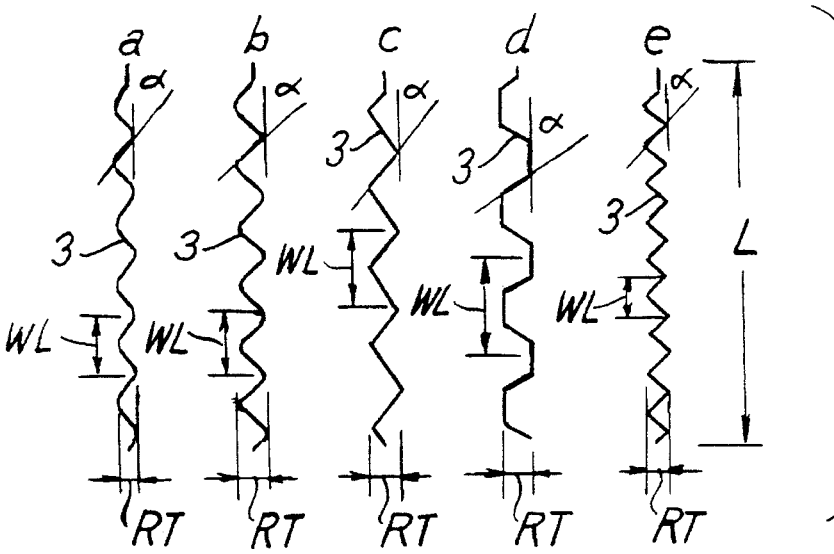
FIG. 1 illustrates a number of profile shapes for the surface of old concrete used in experimental investigations.
Figure 2:
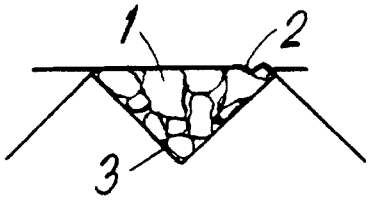
FIGS. 2 and 3 are sectional representations of material bonds with triangularly-shaped bonding surfaces.
Figure 3:
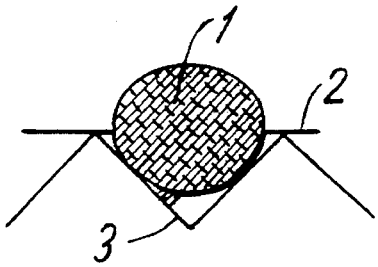

In FIGS. 2 and 3 the grains of the aggregates are designated by 1, the crack progression is designated by 2 and the bonding surface is designated by 3. In the fabrication of old concrete test specimens (by using different shaped formwork) for the experimental checking of the invention, the bonding surface was shaped in different ways. FIG. 1 shows examples of the bonding surface profiles. The profiles are characterized as follows:

a Sine wave flat, b Sine wave deep, c Triangle large, d) Trapezium, e Triangle small. The undulating profile form (sine wave, triangle, trapezium and the like), amplitude (roughness depth) RT and wavelength (undulations) WL were varied to establish the influence of the surface shape of the bonding surface on the fracture behavior in accordance with the invention set forth above. Thus the following dimensions were selected for the test series (dimension in mm):

| | Sine wave Flat | Sine wave Deep | Triangle Large | Trapezium | Triangle Small |
|---|---|---|---|---|---|
| a | 47° | 70° | 42° | 55° | 48° |
| WL | 21 | 21 | 28 | 37 | 14 |
| RT | 7.5 | 12.5 | 11 | 11 | 7.5 |
| L | 130 | 130 | 130 | 130 | 130 |

WL Undulation or wavelength
RT Roughness or wavelength
G Length of ligament

The old and new concrete composition was also varied as to the grain size distribution or to the largest grain size of the aggregate to substantiate these results or effects according to the invention.

The splitting method (patent publication 390 328) was used to test old-new concrete bonds with a profiled bonding surface as well as with "shellsmooth" and "sandblasted" surface treatment. This investigation was performed using different aggregate distributions with different largest grain size, however, having the same surface profiling. The following table shows a partial result of these investigations of old-new concrete bonds of average quality with a largest grain of 16 mm:

| Profile Shape | $F_{max}/F_{max}$ homogenous % | $G_f/G_f$ homogenous % |
|---|---|---|
| | Bonding surface "shellsmooth" | |
| Sine wave deep | 75 | 75.3 |
| Sine wave flat | 54 | 21 |
| Triangle small | 64 | 62 |
| Triangle large | 49 | 50 |
| Trapezium | 50 | 43 |
| Planar | 12 | 5 |
| | Bonding surface "sandblasted" | |
| Sine wave deep | 94 | 99 |
| Sine wave flat | 83 | 78 |
| Triangle small | 74 | 64 |
| Triangle large | 76 | 85 |
| Trapezium | 69 | 80 |
| Planar | 41 | 17 |
| Homogenous test | $F_{max\ hom}$ = 11210N | $G_{f.hom}$ = 90 N/m |

The considerable increase in the specific fracture energy and the maximum force compared with a planar bonded surface in an untreated as well as sand blasted profiled bonding surface is evident from the above table. The specific fracture energy $G_f$ was herein referred to the net ligament surface, meaning on the projection of the bond surface (ligament plane), that is without taking into account the surface increase by profiling. In the following table the $G_f$ value is referred to as the actual surface achieved by the profiling and is designated as the absolute fracture energy $G^o_f$.

| Profile shape | Surface increase % | Shellsmooth $G^{\circ}_f/F_{f.hom}$ ($G_f/F_{f.hom}$) % | Sandblasted $G^{\circ}_f/F_{f.hom}$ ($G_f/F_{f.hom}$) % |
|---|---|---|---|
| Planar | 0 | 5 (5) | 17 (17) |
| Sinewave flat | 21 | 16 (21) | 64 (78) |
| Triangle large | 23.5 | 41 (50) | 68 (85) |
| Trapezium | 25 | 35 (43) | 52 (80) |
| Triangle small | 37 | 45 (62) | 48 (64) |
| Sinewave deep | 63 | 46 (73.5) | 62 (99) |

From this table it can be determined that the absolute fracture energy $G_f$ increases with increasing profiled surface, this applies for the pretreatment "shellsmooth" as well as "sandblasted". There is an exception, however, for the profiled surface "triangle small" sandblasted, which has a strikingly small fracture energy value. This profile surface as compared to the others has a higher number of undulations (number of ribs) at simultaneously smallest profile depths, thus many small area flanks and many edges. In the profile "sine wave deep" sandblasted (surface increase 63%) the fracture energy value $G_f$ attains to all intents and purposes the value of homogeneous concrete. In summary it is noted from this investigation that the absolute fracture energy value $G^{\circ}_f$ increases with an increase of the bonding surface due to the profiling, however, this increase does not run linearly with the increase in surface. The fracture energy growth shares become smaller and smaller with the increase of the surface growth, until the constant $G_f$ value is attained, corresponding to the value of homogeneous material. The course of the $G_f$ increase varies for different profile shapes.

The maximum force $F_{max}$ increases equally as the specific fracture energy non-linearly with increasing profile surfaces, so that the highest measured values at the same level as of homogeneous concrete occurs also for "sine wave deep" sandblasted.

Another important result of this experimental investigation showed, at equal profiling of the surface, that the specific fracture energy achieves the highest value with a surface shaping in accordance with the present invention and that it drops considerably for larger and smaller diameters of the largest grain.

These experimental confirmations of the invention can be explained by the use of models.

If the fractured surface in planar bonded surfaces are considered, then the crack runs, as expected, always along the weaker boundary surface between the old and new concrete. By two or three dimensional profilings of the boundary surface along which the crack runs, the fracture energy increases proportionally to the area increase in a first approximation. With increasing "amplitude" and with this area increase (depending also on the shape of the profiling) the energy expenditure for the crack formation along the boundary surface grows until the point is reached where the fracture energy remains the same or becomes greater with the travel directly through the homogeneous material from one undulation base of the profiled surface to the next and the crack propagates on this path. A further increase of the profiled surface (especially by deepening the profile) no longer involves an increase of the fracture energy, since the crack will take the direct path through the homogeneous material.

The fracture energy of the crack, propagating on the short path from undulation base to undulation base in homogeneous material, is composed of two partial amounts: (a) an amount of lower specific fracture energy, which results from the crack progression at the bonded surface in the undulation base and (b) an amount of higher fracture energy which results from the crack propagation in the solid material. Therefore, the profiled shape should be selected so that this share (a) is as small as possible, meaning the profiled surface is to be given a sine wave or triangular shape or some similar geometric shape. Therefore, the trapezium shape is less suitable.

To date, in the course of these investigations, the characteristics of the rock aggregates (which are much harder than the cement matrix) for concrete bonds were not yet taken into consideration. The aggregate grain size signifies for the crack in the basic material a lengthening of the crack travel, since the crack must circumvent the grain. The larger the grain size diameter, the larger is the detour and also the energy consumption of the crack on the path from one undulation base to the other. This condition is shown diagrammatically in FIG. 2 for small aggregate grains and in FIG. 3 for large aggregate grain sizes (aggregate grain 1, crack travel 2 and bond surface 3). This only applies, however, as long as half the grain size finds room between two undulations of the profiled surface (in this connection note FIG. 3), meaning as long as half the largest diameter of the grain is not greater than approximately the depth of the undulation (roughness depths of the bonded area) of the profiled surface. Otherwise the grain can only extend with a portion of its surface into the intermediate space and is able only to affect the crack lengthening to the extent of only a part of the maximum possible value.

The cooperation of bonding area profiled and aggregate grain leads to a diversion of the crack into the basic material and, in addition, produces mechanical toothing (between grain-grain as well as between grain-cement matrix), which increases the fracture energy in the course of the material fracture.

In summary, this condition shows not only that the mechanical properties of the base and contact material and a roughening and cleaning of the surface to be coated are decisive for a good bonding of cement, bituminous and other bonding materials, but, in addition, the adhesion is also affected by a profiling of the bonding surface which depends on the size of the aggregate material. Only a profiling of the overlay area according to the invention permits bonding with mechanical properties which are practically equivalent to the base material and cannot be attained by the previously used methods.

Figure 4:
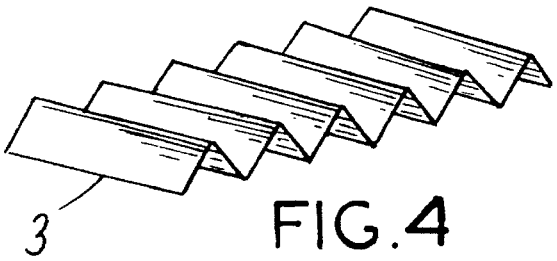
FIGS. 4 and 5 display bonding surfaces undulating along a single axis of a triangular profiled surface in FIG. 4 and a sine curved surface in FIG. 5.
Figure 5:
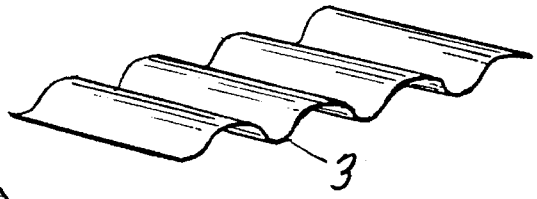
Figure 6:
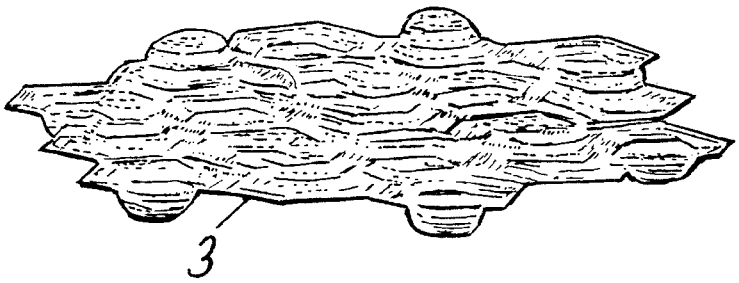
FIG. 6 illustrates a bonding surface undulating along two different axes.

With a single axis of the undulations of overlay areas for cement, bituminous or other bonding materials, the bonding area is subjected to a material removal in such a way that the surface presents the image of a planar transverse wave, as shown in FIG. 4 for triangular profiling and in FIG. 5 for sine shaped profiling. The width of the individual undulations corresponds to the diameter of the largest grain size and the roughness depth or depths of the undulations (measured from undulation base to undulation apex) corresponds to half the diameter of the largest grain size. In case of a biaxial arrangement of the undulations, the surface to be coated is profiled in such a way that the undulations extend in two directions forming a right angle with one another at periodic spacings with recesses, depths, or rises (summits) and that after the surface treatment it exhibits a more or less uniform pattern of pits or summits, as shown diagrammatically in FIG. 6. The spacing of pits or summits is to be dimensioned in such a way, that the depth of the roughness of the profiled surface corresponds to half the diameter of the largest grain and the spacing of the undulation bases ("valleys") or the crests ("mountains") corresponds to the diameter of the largest grains of the aggregate.

The establishment of profiling of the overlay areas according to the invention can be performed by different methods and apparatus. Several such apparatus and methods are as follows.

1. Water jet treatment: Water jet technology (especially at high pressures) can produce a single as well as a two-axis profiled surface, by adjusting the water pressure periodically (in accordance with the triangular or sine curve function) during the course of the treatment. There results a more or less material removal on the surface to be treated and produces the desired single axis profiled surface. This can also be achieved by keeping the water pressure constant and by varying the sweep-across velocity for the duration of the treatment of the surface according to a appropriately predetermined function.

A two axis profiled surface can be achieved by a variation of the water pressure in opposed phases of the pressure resulting from adjacent water jet nozzles disposed at a specific spacing.

2. Mechanical surface treatment: The profiled surface in the invention can be produced by grinding or cutting or milling using rotating or moving hard metal or diamond tipped tool bits. The tool bits can have the desired profile shape or can be guided by appropriate mechanical apparatus so that the desired shape is produced. A very simple variant thereof would be the line-shaped (at a certain spacing) disposition of percussion drills, which form bores having a slight depth on the surface. In the course of machining a surface, the tool bit is successively and repeatedly moved through the diameter of the largest grain size of the aggregate into the not-yet-machined region, thus providing profiling covering the surface or area. Further, it is possible to arrange such drilling devices at regular spacings across a surface or area and then to provide by this arrangement the profiling of successively adjacent partial areas. The drilling devices can also be replaced by ultrasonic hammers or the hammers can be used in combination with the drills.

3. A combination of different surface treatment procedures, as for instance water jet machining and mechanical machining: rational and economic surface treatments can be achieved with devices which produce the profiling of the invention by mechanical machining and water jet treatment (possibly also sandblasting). In this treatment operation, rough material removal can be effected by mechanical methods followed by cleaning with water jets.

A profiling of the surface according to the invention results in great advantages when using adhesive agents as has been validated by experimental results, and indeed by an enormous increase of the adhesive properties of the bond and the saving of adhesive agent material.

In large structures formed of cement bonded material, for instance bonded with bituminous materials in road construction, production characteristics dictate that erection of the structure without material or laminar bond is impossible. In bonds which must satisfy stiff requirements, it is advantageous to produce the profiling during the fabrication of the overlay surface. In road construction, this can be effected by rolling grooves or pit patterns into the asphalt. A short treatment by a water jet is also possible as an alternative pretreatment.

When coating old asphalt where the top surface has been removed by milling (or by other pretreatments), the removal by milling should result with the appropriate profiled surface. A subsequent treatment by water jets and simultaneously cleaning increase the adhesion of the asphalt layer enormously, since the above-described crack deviation effect ("toothing effect") is further increased. The use of more efficient binder agents shares instead of treating by water jet or cleaning cannot substitute for this improvement of the adhesion bond. In this case the crack propagates at cold temperature (at these temperatures the possibility of crack formation is exceedingly high) in a nearly ideal brittle planar layer and is no longer required to make "detours". The laminar bond can be broken in this case without consuming much energy, which means a high susceptibility to cracking.

It should be noted, for instance in road construction, that the rolling track laminar bonds are subject to high shearing stresses which lead to fracture of the bond and subsequently to damage. Such a shear load is optimally carried by profiling the bonding area according to the invention, a crack opening (in mode 1) is prevented by good adhesion of the layers and thus the highest possible resistance is attained against shear cracks.

Care must be taken when coating or bonding concrete in conventional building practice that the undulation should have a roughness depth on the order of magnitude of 10–30 mm, since the usual grades of concrete are produced with the largest grain size in the range of 16 to 32 mm. In building dams, a higher roughness depth must be provided, while on the contrary in building asphalt roads a lower roughness depth is acceptable, because the aggregate has a smaller distribution of the largest sized grains.

If, for instance, metal dowels are utilized to increase and improve adhesion of cement bonded material layers, it is very important for the solidity or endurance of the bond how much the extension or elongation the bond can tolerate without crack formation. The surface pretreatment of the overlay surface in accordance with the invention leads to the largest possible extension or elongation capacity of the bond and thus it guarantees that the dowels can carry and transmit forces through the bond without forming cracks. On the other hand, if the bond has a low elongation or extension capacity, then crack formation occurs initially in the boundary plane and only after that the installed dowels transmit forces to their entire extent or fulfill the intended effect. In most such cases, however, the opening of the crack mouth exceeds the still acceptable standard value.

The coating of damaged concrete roads by a layer of asphalt is cited as a further example of the use of the invention. In case of a layer bond executed in accordance with the invention, the overlay coating can be dimensioned considerably thinner compared to the conventional bonding procedures, since the layer bond of the invention can accept higher tensile and shearing forces without any crack formation. This applies analogously to bonds on a cement bonded base and cement bonded overlay layers quite generally in building, excavation or mining technology. In the construction of industrial furnaces, however, when using refractory materials quite generally in the bonding of heterogeneous ceramic materials, the profiling of the bonding surface in accordance with the invention results in an increase of the adhesion.

While a specific embodiment of the invention has been shown and described in detail to illustrate the inventive principles, it will be understood that the invention may be embodied otherwise without departing from said principles.

I claim:

1. A method of surface treating workpieces formed of cement, bituminous or other bonding materials where a surface of the work pieces has to be coated with a cover layer, such as road, airport, and bridge surfaces where the surface to be coated and the cover layer is formed of grains having a range of sizes and including a largest grain size, including the steps of roughening the surface and forming undulations extending in at least one direction and then cleaning the undulating surface to be coated before applying the coating, wherein the improvement comprises the step of forming the roughened undulating surface with a roughness depth (RT) corresponding to one-half of a diameter of the largest frame size of the grains forming the surface to be coated or of the cover layer the undulations (WL) of the roughened surface having a width corresponding at least to the diameter of the largest grain.

2. A method, as set forth in claim 1, wherein the undulations (WL) extend biaxially.

3. A method, as set forth in claim 1 or 2, wherein the undulations (WL) have a shape of alternating uniform crests and valleys.

4. A method, as set forth in claim 3, wherein the undulations have a sine wave configuration.

5. A method, as set forth in claim 3, wherein the undulations have a triangular shape.

* * * * *